US009381637B1

(12) United States Patent
Sun

(10) Patent No.: US 9,381,637 B1
(45) Date of Patent: Jul. 5, 2016

(54) COMPRESSED AIR TOOL HAVING SILENCER STRUCTURE

(71) Applicant: STORM PNEUMTIC TOOL CO., LTD, Taichung (TW)

(72) Inventor: Yung Yung Sun, Taichung (TW)

(73) Assignee: STORM PNEUMTIC TOOL CO., LTD, Taichung (TW)

( * ) Notice: Subject to any disclaimer, the term of this patent is extended or adjusted under 35 U.S.C. 154(b) by 0 days.

(21) Appl. No.: 14/665,776

(22) Filed: Mar. 23, 2015

(51) Int. Cl.
*F01N 1/08* (2006.01)
*B25D 9/00* (2006.01)
*G10K 11/00* (2006.01)

(52) U.S. Cl.
CPC ..... *B25D 9/00* (2013.01); *G10K 11/002* (2013.01)

(58) Field of Classification Search
CPC ..... B25D 17/12
USPC ..... 181/230
See application file for complete search history.

(56) References Cited

U.S. PATENT DOCUMENTS

| | | | | |
|---|---|---|---|---|
| 4,082,160 | A * | 4/1978 | Schilling et al. | 181/258 |
| 4,134,472 | A * | 1/1979 | Trainor | 181/258 |
| 4,161,996 | A * | 7/1979 | Dolejsi | 181/230 |
| 5,909,016 | A * | 6/1999 | Sterling | 181/230 |
| 5,952,623 | A * | 9/1999 | Sterling | 181/230 |
| 6,209,678 | B1 * | 4/2001 | Sterling | 181/230 |
| 6,739,426 | B2 * | 5/2004 | Sherikar et al. | 181/248 |
| 6,991,043 | B1 * | 1/2006 | Chen | 173/169 |
| 7,216,739 | B2 * | 5/2007 | Sterling | 181/230 |
| 7,753,167 | B2 * | 7/2010 | Fukano et al. | 181/230 |

* cited by examiner

*Primary Examiner* — Forrest M Phillips
(74) *Attorney, Agent, or Firm* — Ming Chow; Sinorica, LLC

(57) ABSTRACT

The present disclosure illustrates a compressed air tool having a silencer structure. A silencing element and an outer cover are disposed in an air exhaust channel of a main body of the compressed air tool. The silencing element has two walls and a channel. The two walls both have long slits, the long slits of the two walls are misaligned and not directly faced with each other. After the exhaust is inputted via the long slits of one of the two walls, the exhaust is flowed through the channel and emitted to the outside via the long slits of other of the two walls. Therefore, the air flow of the exhaust can be weakened, and the exhaust is then entered the countersink of the outer cover and emitted from the side hole, whereby the effect of silencing and reducing the noise caused by the emitted exhaust can be achieved.

5 Claims, 11 Drawing Sheets

COMPRESSED AIR TOOL HAVING SILENCER STRUCTURE

BACKGROUND OF THE INVENTION

1. Field of the Invention

The present disclosure relates to a compressed air tool, more particularly to a compressed air tool having a silencer structure.

2. Description of the Related Art

While being operated, the compressed air tool used in industrial field is usually connected to an gas source, and the high pressure gas is entered to drive an air motor via an inlet, such that a tool head of the compressed air tool starts to act, and the exhaust generated during operation of the air motor is emitted o the outsides via an air exhaust channel. In order to reduce the noise generated during the emission of the exhaust via the air exhaust channel, a silencer is usually disposed at the air exhaust channel. Main elements of the silencer for silencing includes silencing cotton made of cotton or non-woven fabric, or copper silencer which has numerous tiny holes formed by copper particles.

As shown in FIG. 11, at a bottom of a handle 82 of a traditional compressed air tool 8, a silencer 9 is disposed in an air exhaust pipe 81 of the traditional compressed air tool 8. The silencer 9 is formed by arranging a plurality of silencing cottons 93 between an inner pipe 91 and an outer pipe 92. The exhaust emitted from the air exhaust pipe 81 of the compressed air tool 8 is entered into the silencing cotton 93 via the inner pipe 91, and flowed through the interstices of the silencing cotton 93, so the air flow of the exhaust is buffered to become weaker, and the exhaust is then emitted via the outer pipe 92, so as to obtain an effect of silencing and reducing noise.

However, while the compressed air tool is driven by the high pressure gas, the emitted exhaust may include oil. When the silencing cotton 93 is used as the silencing element, the oil included in the exhaust may jam the interstices of the silencing cotton 93 after the emitted exhaust is passed the silencing cotton 93 for a period of time, and it causes the problem of non-smooth exhaust emission, and such problem may make the air motor be driven inefficient. The tiny holes between the copper particles of the copper silencer may be jammed by the oil included in the exhaust, so the aforesaid problem occurred in the silencing cotton may also happen in the copper silencer.

SUMMARY OF THE INVENTION

A primary objective of the present disclosure is to provide a compressed air tool having a silencer structure for solving aforesaid problems, so that the exhaust can be emitted smoothly and the problem of air motor being driven inefficiently can be prevented.

To achieve the above-mentioned objective, the present disclosure is to provide a compressed air tool including a main body, a silencing element and an outer cover.

The main body includes an air intake channel to enter high pressure gas. The high pressure gas is passed into the main body under control of a trigger to drive an air motor, and the air motor correspondingly drives an operation of a tool head. The main body includes an air exhaust channel to emit exhaust which is generated after the air motor is driven by the high pressure gas.

The silencing element is disposed inside the air exhaust channel of the main body and has two walls. Each of the two walls has a plurality of long slits for passing the exhaust. In a flow path for passing the exhaust, one of the two walls is located prior to the other. The two walls are spaced apart by a distance, and a channel is formed therebetween. The long slits of one of the two walls are misaligned with and do not face toward that of the other of two walls. Each of the long slits has a width ranged from 0.3 mm to 0.8 mm and a length being at least six times of the width. In depth direction, each of the long slits is axially penetrated the wall where the long slit is located, to communicate with the channel.

The outer cover is fastened at an end of the air exhaust channel in the main body, the outer cover has a countersink therein, and the countersink is provided with an opening faced toward the silencing element and communicated with the plurality of long slits of the wall at back position. The outer cover has a side hole laterally penetrated therethrough.

In the air exhaust channel, the exhaust is inputted into the channel via the long slits of the wall at front position, and is flowed along the channel and into the countersink of the outer cover through the long slits of the wall at the back position, and then laterally emitted to the outside via the side hole.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
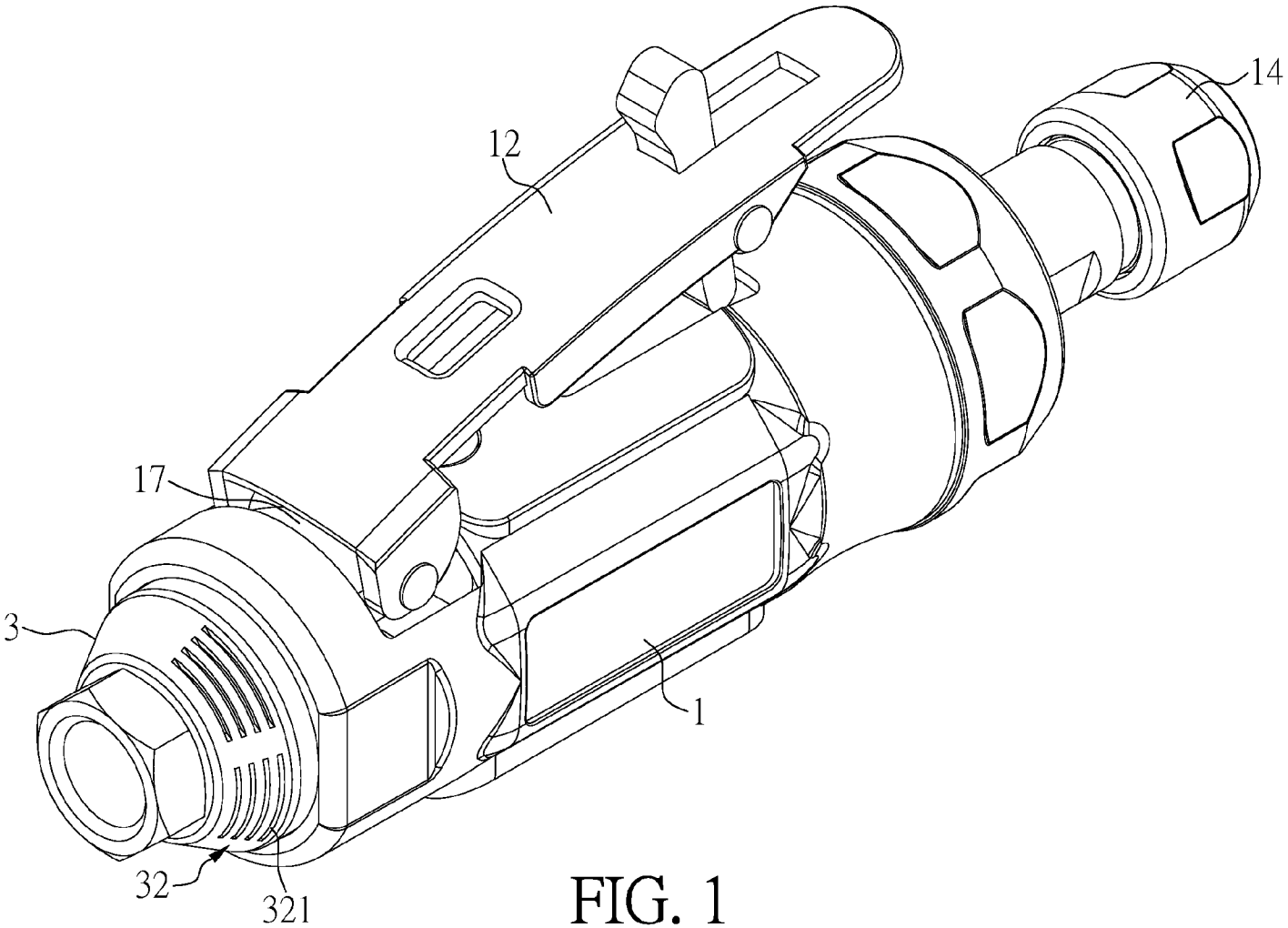
FIG. 1 is a perspective appearance view of a compressed air tool of a first embodiment of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Please refer to FIG. 1 through FIG. 10 which show structures of two embodiments of the present disclosure. These two embodiments are taken as examples for illustration, but the present disclosure is not limited thereto.

Figure 2:
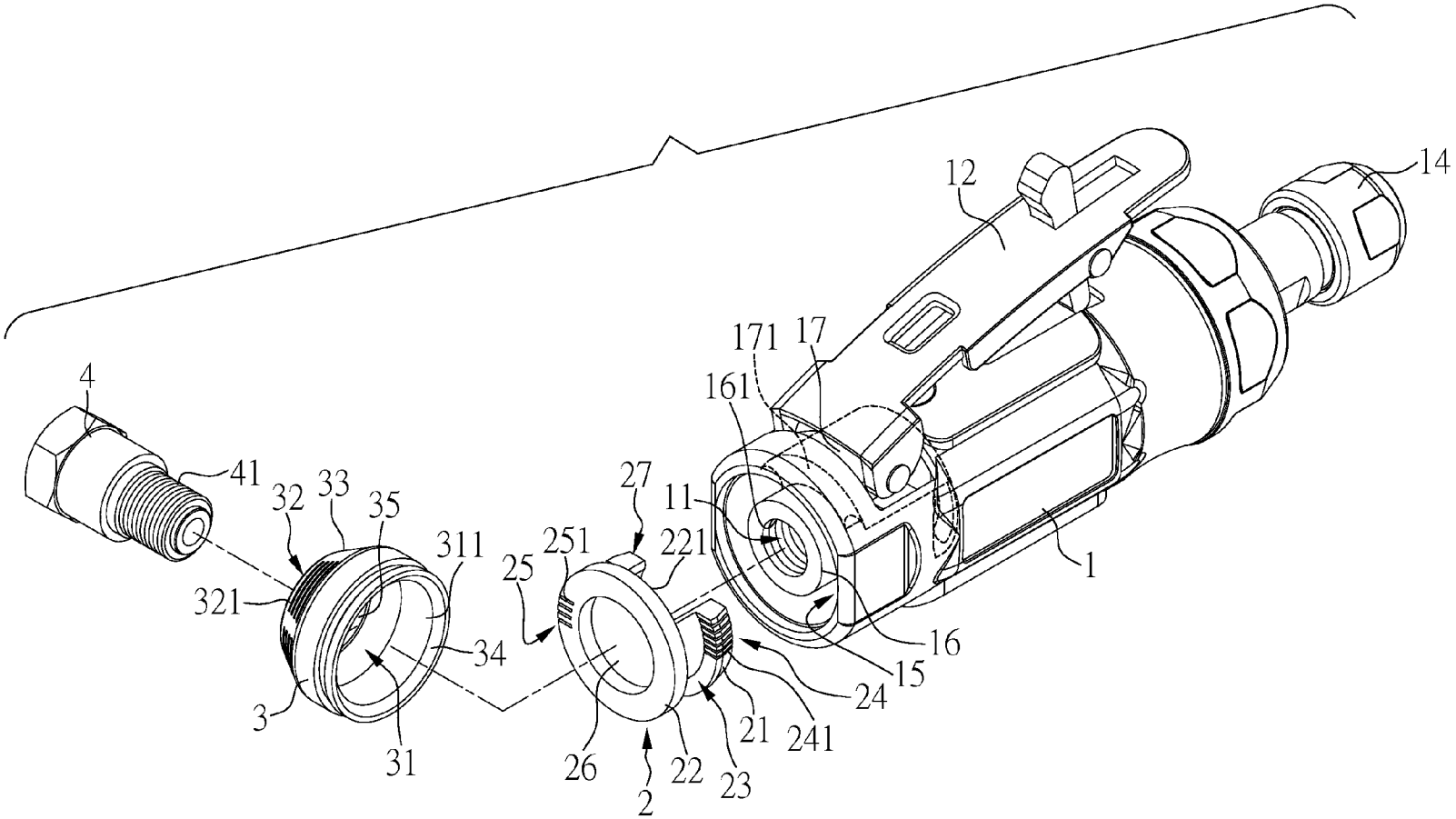
FIG. 2 is an exploded view of the compressed air tool of the first embodiment of the present disclosure.

FIG. 1 and FIG. 2 show the first embodiment, the compressed air tool includes a straight type main body 1, a silencing element (a silencer ring 2 in this embodiment) and an outer cover 3.

Figure 3:
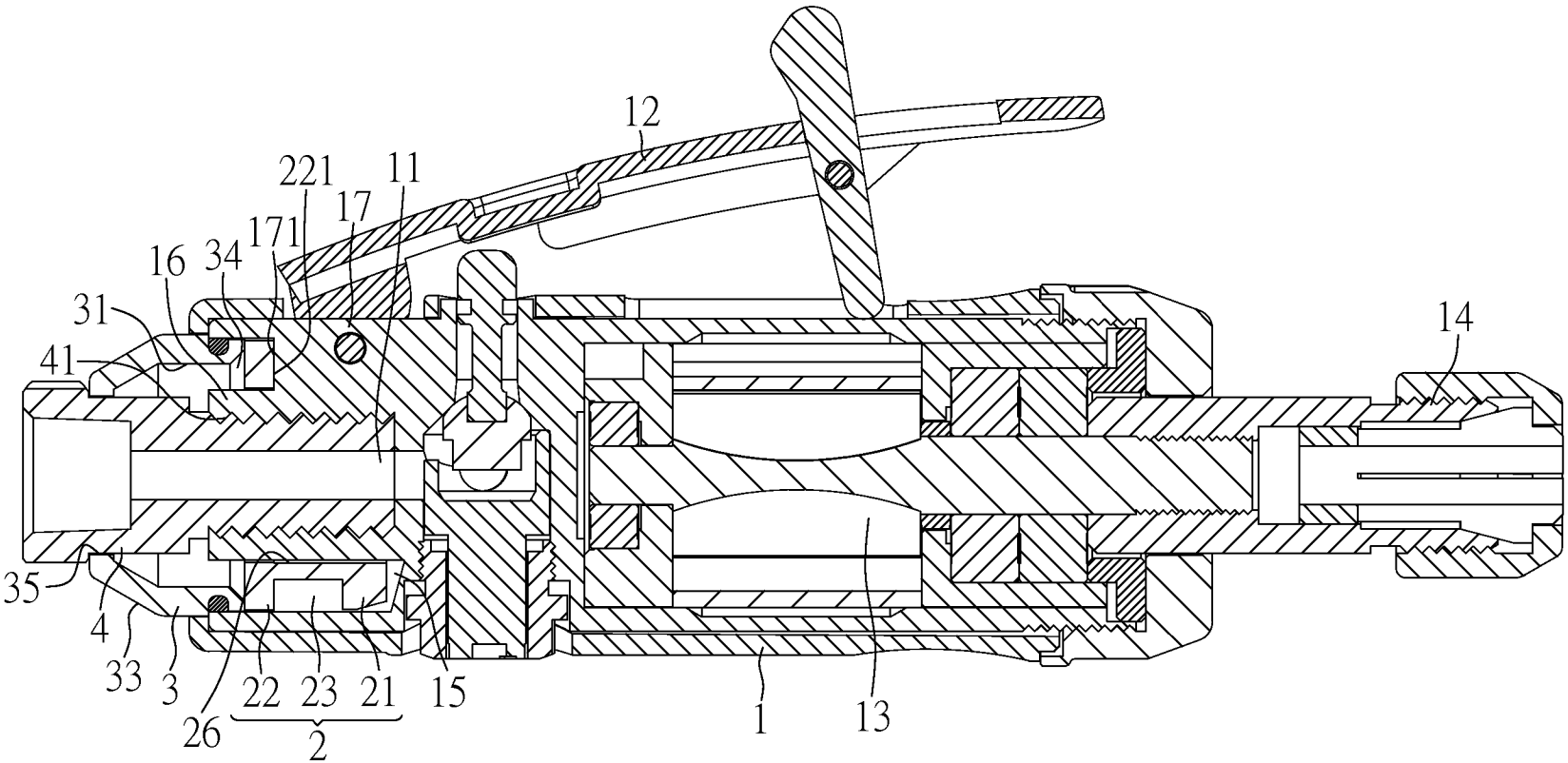
FIG. 3 is an axially longitudinal sectional view of the compressed air tool of the FIG. 1.

As shown in FIG. 2 and FIG. 3, the main body 1 includes an air intake channel 11 to enter high pressure gas. The high pressure gas is passed into the main body 1 under control of a trigger 12 to drive an air motor 13, and the air motor 13 correspondingly drives an operation of a tool head 14. The main body 1 includes an air exhaust channel 15 to emit exhaust which is generated after the air motor 13 is driven by the high pressure gas.

As shown in FIG. 2 and FIG. 3, in this embodiment the air exhaust channel 15 is provided with a pipe part 16, and the pipe part 16 is provided with an inner screw thread 161. The air intake channel 11 is located inside the pipe part 16 and separated from the air exhaust channel 15 by the pipe part 16. The main body 1 has a pivot part 17 close to the outer cover 3 at a side thereof. The pivot part 17 is communicated with the pipe part 16 inside the main body 1 and has a stop surface 171 toward outside of the air exhaust channel 15, and the trigger 12 is pivotally linked with the pivot part 17 by an end thereof.

The silencing element is disposed inside the air exhaust channel 15 of the main body 1 and has two walls. Each of the two walls has a plurality of long slits for passing the exhaust. In the flow path for passing the exhaust, one of the two walls is located prior to the other. The two walls are spaced apart by a distance, and a channel is formed therebetween. The long slits of one of the two walls are misaligned with and not faced toward that of the other of two walls. Each of the long slits has a width ranged from 0.3 mm to 0.8 mm and a length being six times of the width. In depth direction, the long slit is axially penetrated the wall where the long slit is located, to communicate with the channel. In this embodiment, a silencer ring 2 is served as the silencing element, and a front ring-like convex portion 21 and a back ring-like convex portion 22 of the silencer ring 2 which are radially protrudingly disposed along peripheral edges of the two ends of the silencer ring 2 are served as the two walls. A channel 23 is formed at a recessed space between the two ring-like convex portions 21 and 22, and the channel 23 is in an annular shape.

Two ring-like convex portions 21 and 22 of this embodiment are just provided with slit groups 24 and 25 respectively, and the plurality of long slits 241 and 251 for passing the exhaust are respectively collected to form the slit groups 24 and 25. The slit group 24 of the ring-like convex portion 21 is misaligned with and not directly faced toward the slit group 25 of the ring-like convex portion 22. The slit group 24 of the front ring-like convex portion 21 and the slit group 25 of the back ring-like convex portion 22 are located at two sides away from each other.

Figure 5:
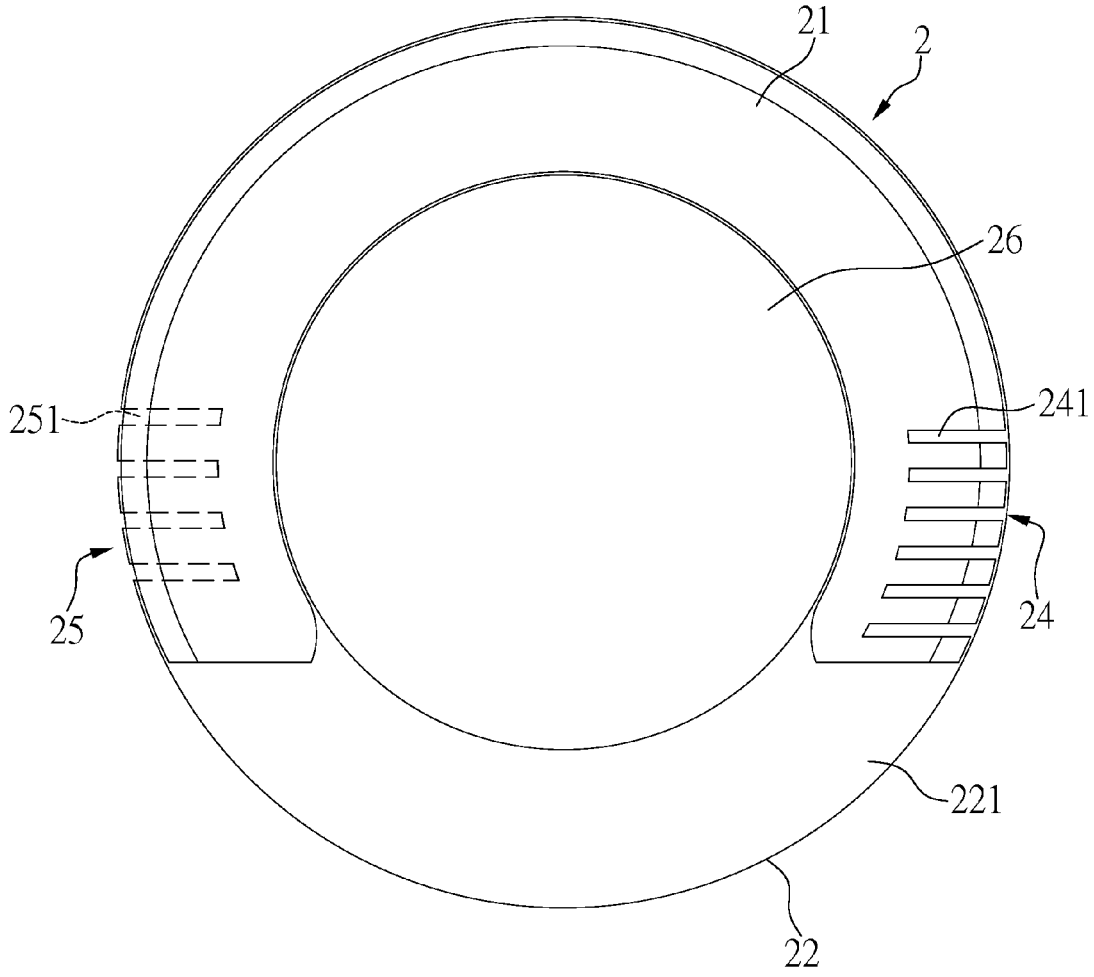
FIG. 5 is a top plan view of a silencer ring of the first embodiment of the present disclosure, and shows a length and a width of a long slit.

As shown in FIG. 5, the width of the long slit 241 is 0.4 mm, the width of the long slit 251 is 0.5 mm, and the length of the long slit 241 and the long slit 251 both is 3.0 mm. The long slits 241 and 251 of this embodiment are radially disposed along a slit-length direction thereof and respectively penetrated the ring-like peripherals of the ring-like convex portions 21 and 22.

Figure 4:
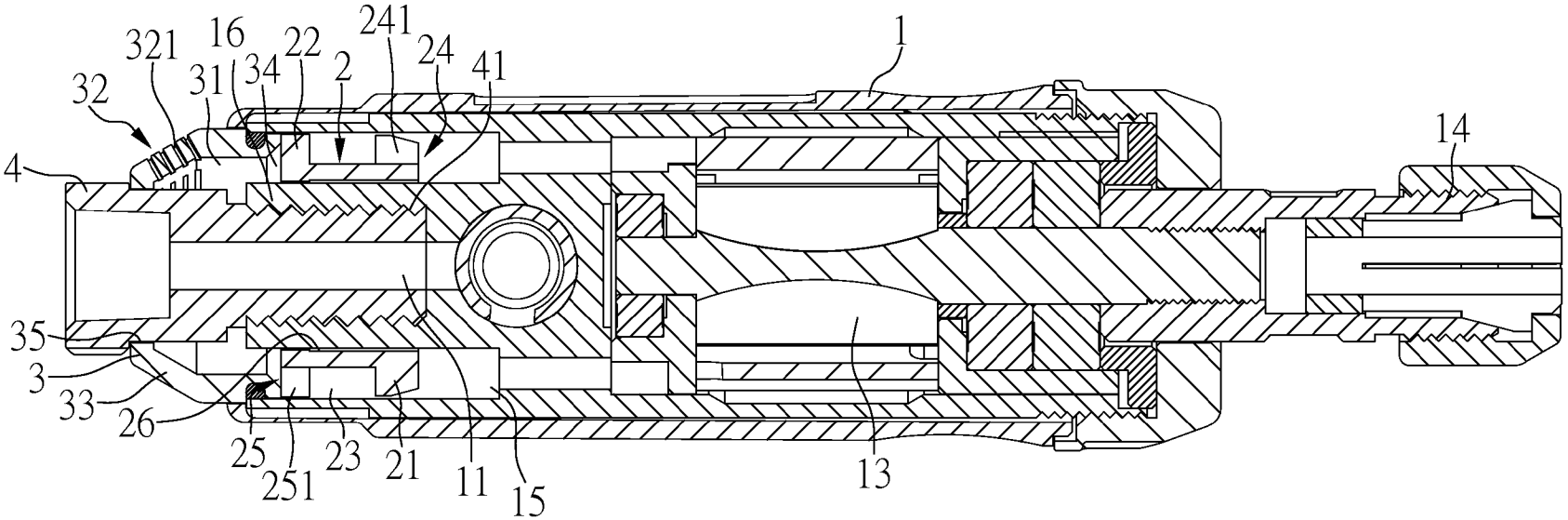
FIG. 4 is an axially transverse sectional view of the compressed air tool of the FIG. 1.

As shown in FIG. 1, FIG. 2 and FIG. 4, the outer cover 3 is provided with a countersink 31 which has an opening 311 faced the silencer ring 2 and communicated with the slit group 25 of the back ring-like convex portion 22. The outer cover 3 is provided with a side hole laterally penetrated therethrough. In this embodiment, the side hole of this embodiment is the slit group 32 shown in FIGs, the slit group 32 is formed by the collection of the plurality of long slits 321, and each of the long slits 321 has a 0.8 mm of width and a length ranged from 10 mm to 12.5 mm.

As shown in FIG. 2 through FIG. 5, the silencer ring 2 is placed into the air exhaust channel 15 of the main body 1 in a way that the front ring-like convex portion 21 is front and the back ring-like convex portion 22 is back. The two ring-like convex portions 21 and 22 have shapes matching with an inner contour of the air exhaust channel 15 to fully fill the air exhaust channel 15. The outer cover 3 is fastened at an end of the air exhaust channel 15 in the main body 1, and is abutted against back ring-like convex portion 22 by an end thereof.

The outer cover 3 of this embodiment includes an awl-like part 33 which has a gradually contracted outer diameter of an end thereof away from the main body 1. The slit group 32 of the side hole is disposed on the awl-like part 33. The outer cover 3 is abutted against the back ring-like convex portion 22 by an end thereof, and an outer diameter of the end is equal to the back ring-like convex portion 22. The outer cover 3 is provided with a bevel 34 at the opening 311 of the countersink 31 thereof and the bevel 34 is gradually expanded toward the opening 311. The slit group 25 of the back ring-like convex portion 22 can be communicated with the countersink 31 via the bevel 34.

In this embodiment, the silencer ring 2 is provided with a central hole 26 and a gap 27. The silencer ring 2 is mounted on a periphery of the pipe part 16 by the central hole 26 thereof, and avoids the pivot part 17 via the gap 27 to be inserted into the air exhaust channel 15. The side surface 221 of the back ring-like convex portion 22 is abutted against the stop surface 171, so that the silencer ring 2 is positioned in the air exhaust channel 15. The outer cover 3 is also provided with a central hole 35. A gas connector 4 is provided with an outer screw thread 41 at an end thereof, passed through the central hole 35 of the outer cover 3, and screwed with the inner screw thread 161 of the pipe part 16. The outer cover 3 is forced by the gas connector 4 to abut against the back ring-like convex portion 22 by the end thereof.

Figure 6:
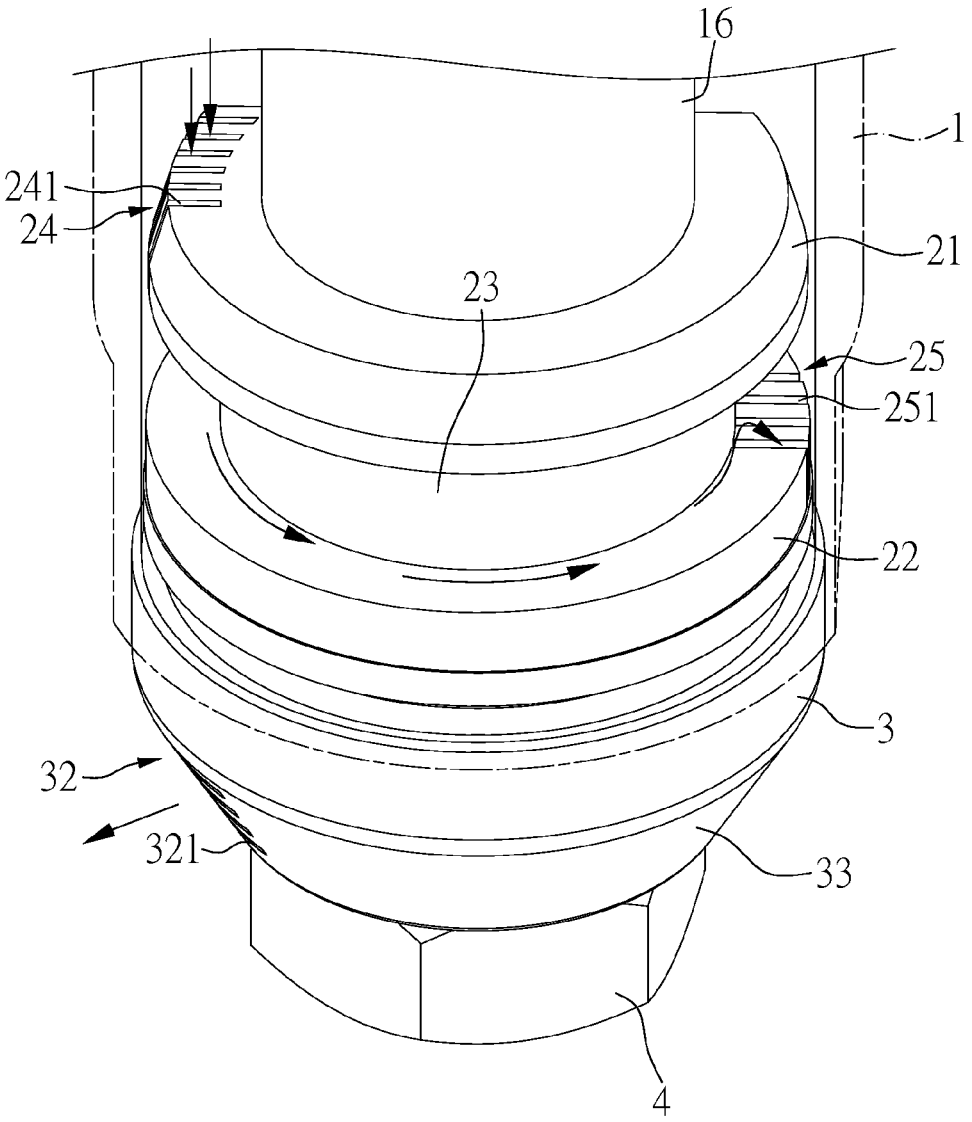
FIG. 6 is a perspective view of the silencer ring and an outer cover of the first embodiment of the present disclosure during the exhaust emission.
Figure 7:
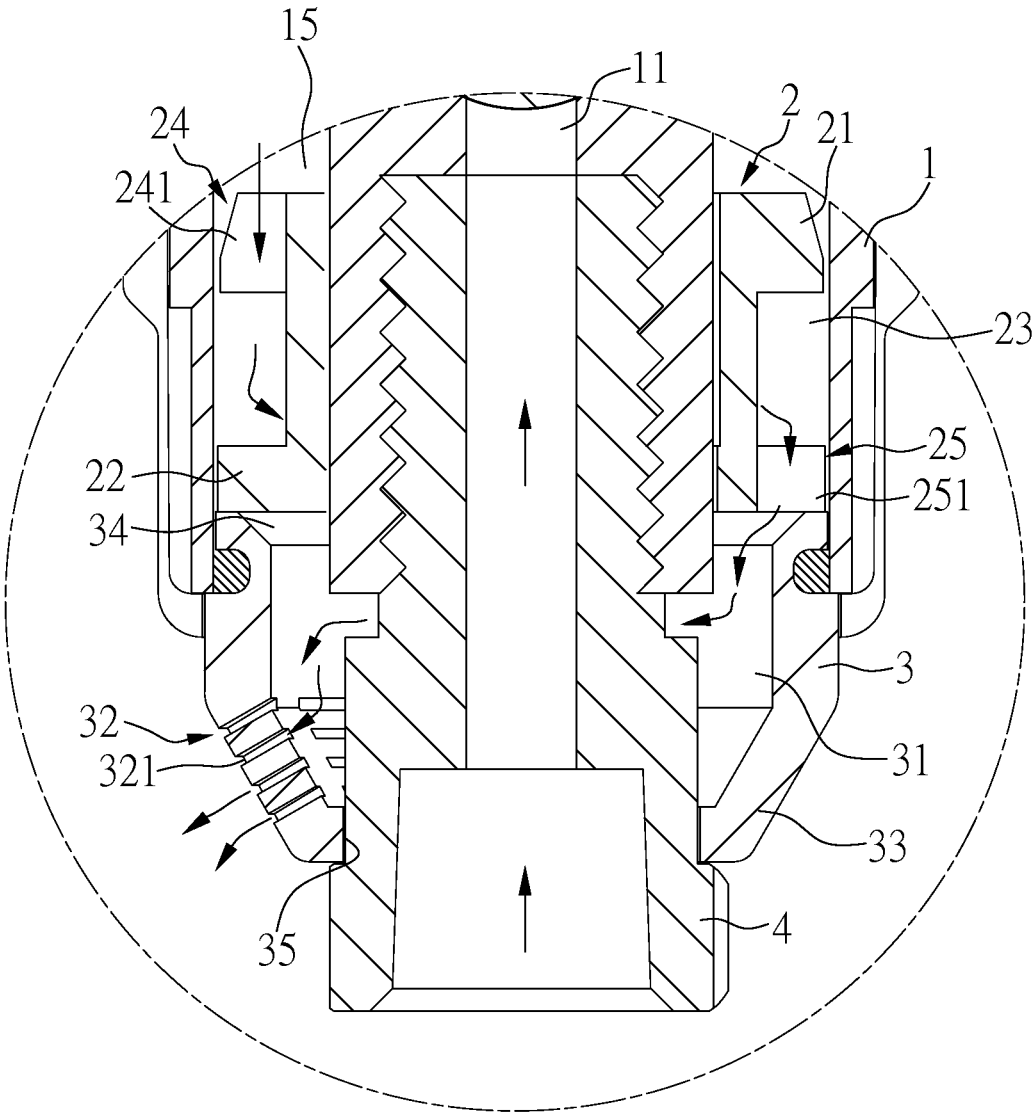
FIG. 7 is a cross-sectional view of the silencer ring and the outer cover of the first embodiment of the present disclosure during the exhaust emission.
Figure 8:
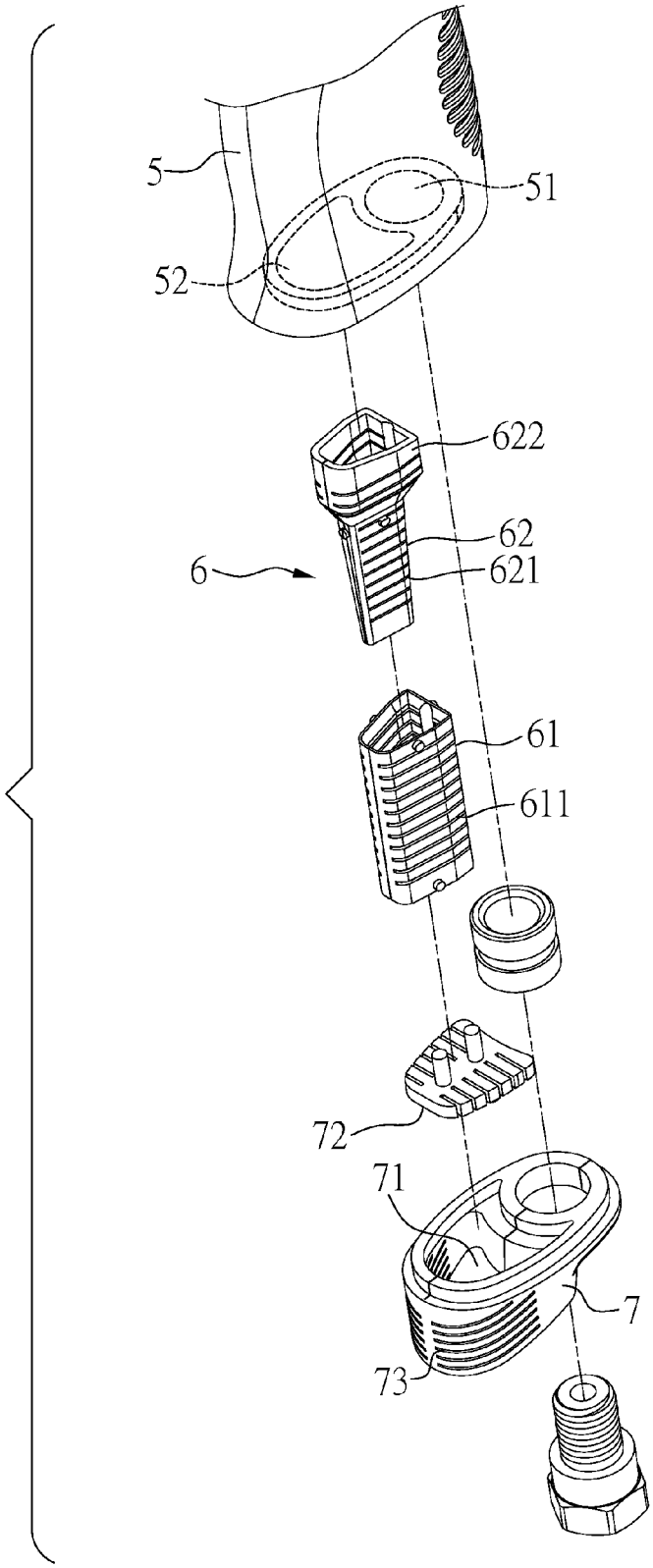
FIG. 8 is an exploded view of a handle of the compressed air tool of a second embodiment of the present disclosure.

Please refer to the FIG. 6 and FIG. 7. While the exhaust is generated after the air motor 13 is driven, the exhaust in the air exhaust channel 15 is emitted into the channel 23 through the slit group 24 of the front ring-like convex portion 21, and changed direction along the channel 23 to flow through the slit group 25 of the back ring-like convex portion 22 to enter the countersink 31 of the outer cover 3, and laterally emitted to the outside through the slit group 32. During the emission of the exhaust through the silencer ring 2 and the outer cover 3, because the slit group 24 of the front ring-like convex portion 21 is formed by the collection of the long slits 241 with above-mentioned length-to-width ratio, the exhaust can be flowed in a sufficient amount of flow but generate lower flow sound. After the exhaust is passed through the slit group 24 to enter into the channel 23, the exhaust is changed direction to flow along the channel 23, so the sound of air flow may be weakened. The exhaust is then passed through the long slits 251 of the slit group 25, so the sound of air flow is weakened again. Next, the exhaust is inputted into the countersink 31 of the outer cover 3 and emitted to the outside via the slit group 32, so the sound of air flow is weakened once more.

According to the description, it is obvious that the present disclosure has following advantages. First, the two ring-like convex portions 21 and 22 of the silencer ring 2 are respectively provided with slit groups 24 and 25 formed by collection of the long slits 241 and 251, and the channel 23 is formed between the two ring-like convex portions 21 and 22, and the outer cover 3 is provided with the side hole (such as the slit group 32), so the exhaust is flowed in a roundabout way during the emission process but not emitted outwardly in straight way. Therefore, the sound of the air flow can be weakened efficiently and the effect of silencing and reducing noise can be achieved. Secondly, in the silencing path of the present disclosure, the traditional silencing element including the silencing cotton or the copper particle is not used, instead the air flow is passed through the slit groups, the channel and the side hole to weaken sound, so that the exhaust emission can be performed smoothly and the problem of the air motor being driven inefficiently can be prevented.

Naturally, there are many examples embraced by the scope of the present disclosure, and these examples just have different variations in detail. Please refer to FIG. 8 through FIG. 10. A main difference between the second embodiment and the first embodiment of the present disclosure is that the main body of the compressed air tool of the second embodiment is in a gun shape and the main body includes a handle 5 which is provided with an air intake channel 51 and an air exhaust channel 52. In the second embodiment, the compressed air tool includes a silencing element 6 and an outer cover 7, and the silencing element 6 includes an outer sleeve 61 and an inner sleeve 62. The pipe walls of the outer sleeve 61 and the inner sleeve 62 are used as the two walls. The outer sleeve 61 is provided with a plurality of long slits 611 arranged in parallel along the pipe-length direction thereof, and the inner sleeve 62 is provided with a plurality of long slits 621 arranged in parallel along the pipe-length direction thereof. The inner sleeve 62 is inserted into the outer sleeve 61, and a head portion 622 of the inner sleeve 62 is exposed out of the outer sleeve 61, the head portion 622 has a structure matching with an inner contour of the air exhaust channel 52 and is used to fill the air exhaust channel 52 fully. A channel 63 is formed between the outer sleeve 61 and the inner sleeve 62. The silencing element 6 is placed into the air exhaust channel 52 of the main body 5 in a way that the inner sleeve 62 is located inside and the outer sleeve 61 is located outside. In the air exhaust channel 52, the exhaust is passed into the channel 63 via the long slits 621 of the inner sleeve 62, and is flowed along the channel 63 and into the countersink 71 of the outer cover 7 via the long slits 611 of the outer sleeve 61.

In this embodiment, a pad member 72 is disposed between the silencing element 6 and the outer cover 7 in the air exhaust channel 52. The pad member 72 is abutted with the outer cover 7 by a side thereof faced the outer cover 7, and is used to cushion the silencing element 6 in the air exhaust channel 52 by other side thereof faced the silencing element 6. The pad member 72 is provided with a plurality of long slits 721, and the exhaust flowing through the outer sleeve 61 can be passed the plurality of long slits 721 to enter the countersink 71 of the outer cover 7.

The silencing element 6 of this embodiment is formed by inserting the inner sleeve 62 into the outer sleeve 61, and the long slits 611 of the outer sleeve 61 and the long slits 621 of the inner sleeve 62 are misaligned and not directly faced with each other.

Figure 9:
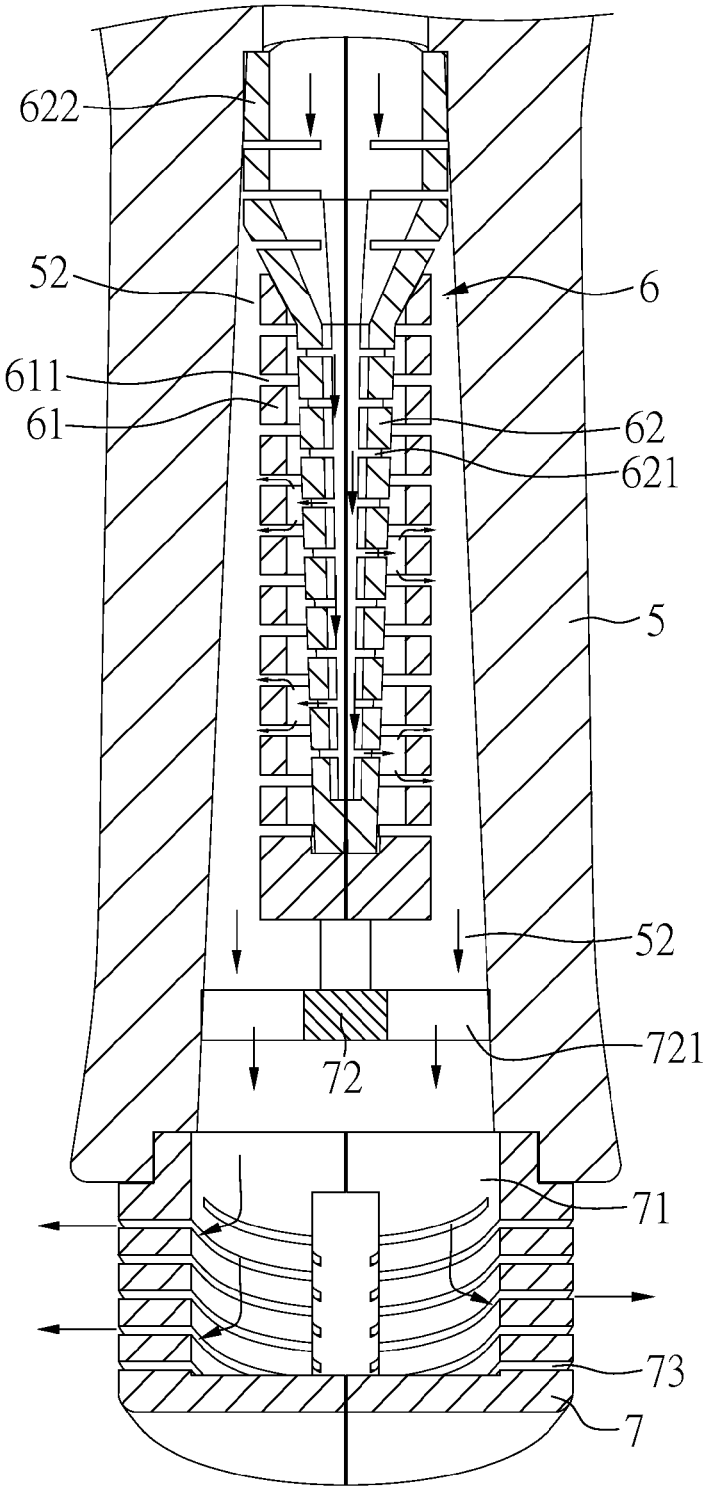
FIG. 9 is a cross-sectional view of the structure of the handle of the compressed air tool of the second embodiment of the present disclosure and shows the flow of the exhaust emission.
Figure 10:
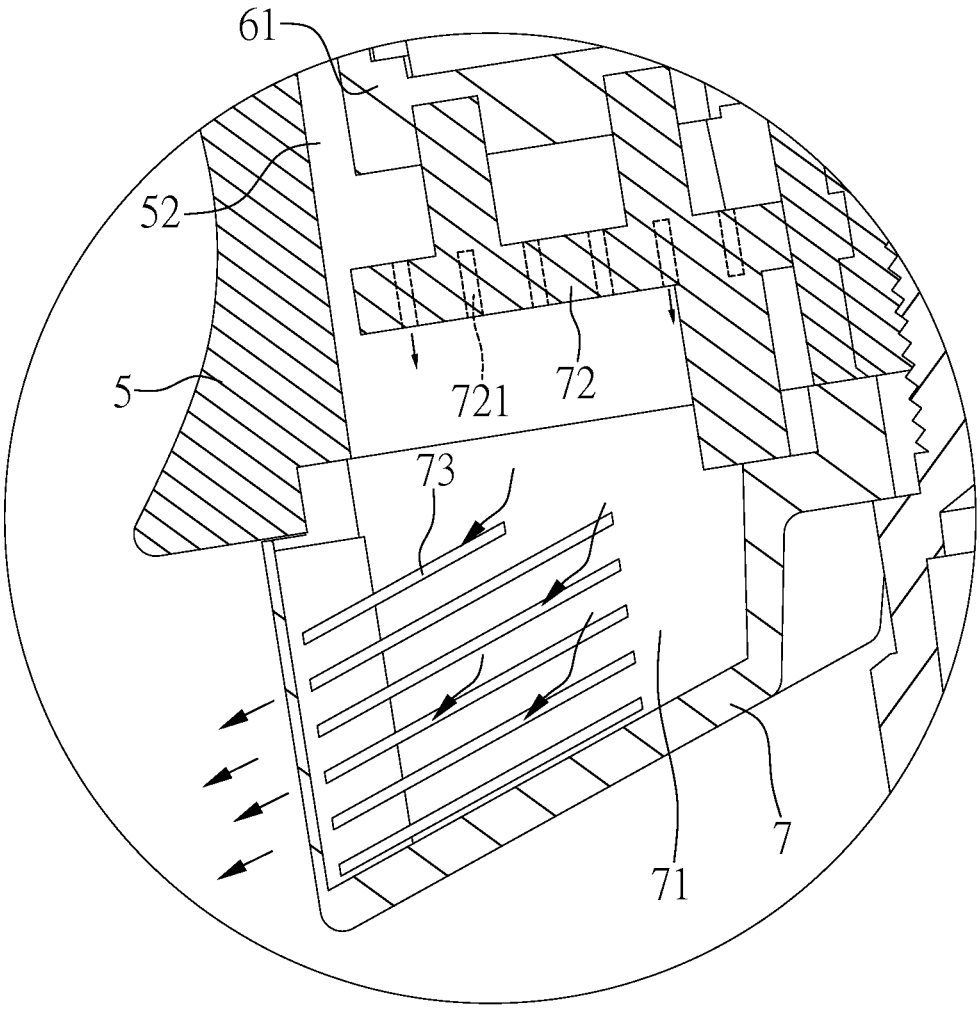
FIG. 10 is a partial cross-sectional view of the outer cover of the compressed air tool of the second embodiment of the present disclosure and shows the flow of the exhaust emission.
Figure 11:
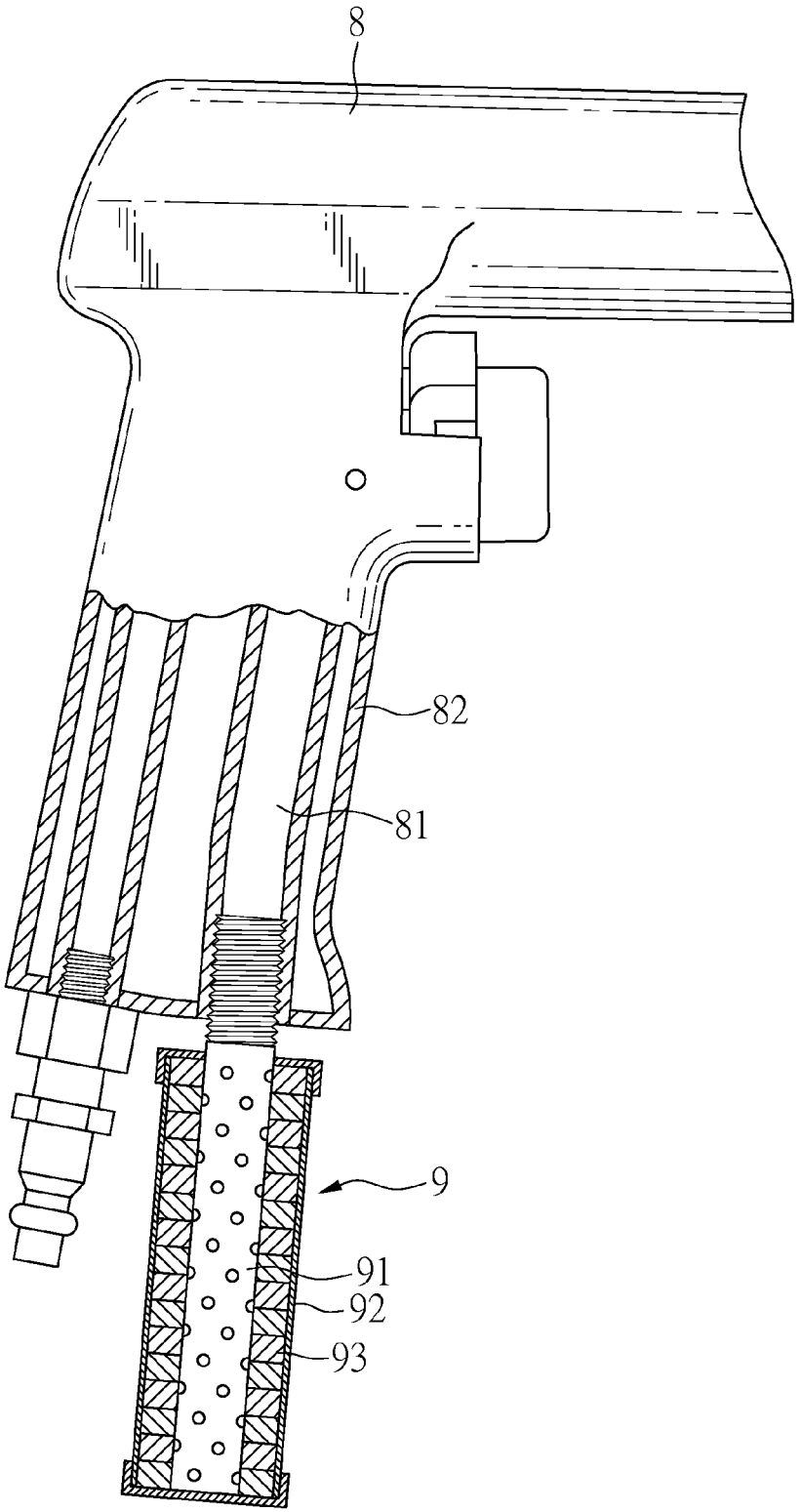
FIG. 11 PRIOR ART
FIG. 11 is a plan view of a silencer structure of a traditional compressed air tool.

Please refer to FIG. 9 and FIG. 10. When the exhaust is passed through the silencing element 6 in the air exhaust channel 52, the exhaust is inputted into the inner sleeve 62 first and then laterally emitted into the channel 63 via the plurality of long slits 621. The long slits 611 and the long slits 621 are misaligned and not faced with each other directly, so the exhaust in the channel 63 is directly emitted to the outside via the long slits 621, but air flow of the exhaust is frequently obstructed to become weaker. The exhaust is then inputted the countersink 71 of the outer cover 7 through the long slits 721 of the pad member 72, and emitted to the outside via the side hole 73 of the outer cover 7. Therefore, the air flow of the exhaust is weakened in a multi-layer way to achieve the silencing effect the same as that of the first embodiment.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A compressed air tool having a silencer structure, comprising:

a main body, comprising an air intake channel to enter high pressure gas, the high pressure gas passed into the main body under control of a trigger to drive an air motor, the air motor correspondingly driving an operation of a tool head, the main body comprising an air exhaust channel to emit exhaust which is generated after the air motor is driven by the high pressure gas;

a silencing element, disposed inside the air exhaust channel of the main body and comprising two walls, and each of the two walls having a plurality of long slits for passing the exhaust, wherein in an flow path for passing the exhaust, one of the two walls is located prior to the other, and the two walls are spaced apart by a distance, and a channel is formed between the two walls, the long slits of one of the two walls are misaligned with and not faced toward that of the other of two walls, each of the long slits has a width ranged from 0.3 mm to 0.8 mm, and a length being at least six times of the width, in depth direction the long slit is axially penetrated the wall where the long slit is located, to communicate with the channel;

an outer cover, fastened at an end of the air exhaust channel in the main body, the outer cover having a countersink therein, and the countersink provided with an opening faced toward the silencing element and communicated with the plurality of long slits of the wall at back position, and the outer cover having a side hole laterally penetrated therethrough;

wherein in the air exhaust channel, the exhaust is passed into the channel via the long slits of the wall at front position, and is flowed along the channel and into the countersink of the outer cover through the long slits of the wall at the back position, and then laterally emitted to the outside via the side hole;

wherein the silencing element is a silencer ring, and the two walls are a front ring-like convex portion and a back ring-like convex portion radially protrudingly disposed along peripheral edges of the two ends of the silencer ring respectively, the channel is formed at a recessed space between the front ring-like convex portion and the back ring-like convex portion, and the channel is in an annular shape, the silencer ring is placed into the air exhaust channel of the main body in a way that the front ring-like convex portion is front and the back ring-like convex portion is back, and the front ring-like convex portion and the back ring-like convex portion have shapes matching with an inner contour of the air exhaust channel to fully fill the air exhaust channel, each of the front ring-like convex portion and the back ring-like convex portion of the two walls is provided with at least one slit group, and the slit groups are respectively formed by collections of the plurality of long slits of the front ring-like convex portion and the back ring-like convex portion; and wherein the air exhaust channel is provided with a pipe part which has an inner screw thread, the air intake channel is located inside the pipe part and separated from the air exhaust channel by the pipe part, the silencer ring is provided with a first central hole, and the silencer ring is mounted on a periphery of the pipe part inside the air exhaust channel via the first central hole, the outer cover is provided with a second central hole, and a gas connector provided with an outer screw thread at an end thereof is inserted into the second central hole of the outer cover and screwed with the inner screw thread of the pipe part, and the outer cover is forced by the gas connector to abut against the back ring-like convex portion by the end thereof;

wherein the main body has a pivot part close to the outer cover and disposed at a side thereof, and the pivot part is communicated with the pipe part inside the main body and has a stop surface toward the outside of the air exhaust channel, and an end of the trigger is pivotally linked with the pivot part, the silencer ring is provided with a gap, the silencer ring avoids the pivot part via the gap to be inserted into the air exhaust channel, and the back ring-like convex portion is abutted against the stop surface by a the side surface thereof for being positioned.

2. The compressed air tool as defined in claim 1, wherein each of the front ring-like convex portion and the back ring-like convex portion is just provided with one slit group, and the slit groups of the front ring-like convex portion and the back ring-like convex portion are respectively located at two sides away from each other.

3. The compressed air tool as defined in claim 1, wherein the side hole is also a slit group formed by the collection of a plurality of long slits.

4. The compressed air tool as defined in claim 3, wherein the outer cover is provided with an awl-like part, and the slit group of the side hole is disposed on the awl-like part, and an outer diameter of an end of the awl-like part away from the main body is gradually contracted.

5. The compressed air tool as defined in claim 4, wherein the outer cover is abutted against the back ring-like convex portion by an end thereof and an outer diameter of the end is equal to the back ring-like convex portion, the outer cover is provided with a bevel at the opening of the countersink thereof and the bevel is gradually expanded toward the opening, so that the slit group of the back ring-like convex portion can be communicated with the countersink via the bevel.

* * * * *